US008330573B2

(12) United States Patent
Crucs

(10) Patent No.: US 8,330,573 B2
(45) Date of Patent: Dec. 11, 2012

(54) SYSTEMS, METHODS, AND KITS FOR AUTOMATICALLY ACTIVATING A GARAGE DOOR BY SENSING MOTION OF AN AUTOMOBILE

(75) Inventor: Kevin M. Crucs, Copley, OH (US)

(73) Assignee: Crucs Holdings, LLC, Copley, OH (US)

( * ) Notice: Subject to any disclaimer, the term of this patent is extended or adjusted under 35 U.S.C. 154(b) by 0 days.

(21) Appl. No.: 13/358,618

(22) Filed: Jan. 26, 2012

(65) Prior Publication Data

US 2012/0139700 A1 Jun. 7, 2012

Related U.S. Application Data

(62) Division of application No. 12/465,344, filed on May 13, 2009, now Pat. No. 8,154,382.

(51) Int. Cl.
*G08B 21/00* (2006.01)

(52) U.S. Cl. ..... 340/5.71; 340/539.1; 340/5.64

(58) Field of Classification Search ..... 340/5.64, 340/5.7, 5.71, 541, 539.1; 455/418–420, 455/41.2; 318/480; 341/176
See application file for complete search history.

(56) References Cited

U.S. PATENT DOCUMENTS

| | | | | |
|---|---|---|---|---|
| 2005/0088281 | A1* | 4/2005 | Rohrberg et al. | 340/5.71 |
| 2005/0258935 | A1* | 11/2005 | Hom et al. | 340/5.62 |
| 2006/0111053 | A1 | 5/2006 | Wu et al. | |
| 2006/0176171 | A1* | 8/2006 | Fitzgibbon | 340/531 |
| 2006/0180647 | A1 | 8/2006 | Hansen | |
| 2006/0226948 | A1 | 10/2006 | Wright et al. | |
| 2008/0273684 | A1 | 11/2008 | Profanchik | |

FOREIGN PATENT DOCUMENTS

| | | | |
|---|---|---|---|
| WO | 2008/041016 | A1 | 4/2008 |

* cited by examiner

*Primary Examiner* — Jeffery Hofsass
(74) *Attorney, Agent, or Firm* — Hahn Loeser & Parks LLP

(57) ABSTRACT

Systems, methods, and kits for automatically activating a garage door opener. A garage door opener system is supplemented with motion sensor technology or RFID technology to allow for automatic activation of a garage door opener. An automobile that is moving near or is proximate to a garage associated with at least one garage door opener can cause the garage door opener to be automatically activated to open or close a garage door that is operatively connected to the garage door opener.

17 Claims, 9 Drawing Sheets

SYSTEMS, METHODS, AND KITS FOR AUTOMATICALLY ACTIVATING A GARAGE DOOR BY SENSING MOTION OF AN AUTOMOBILE

This U.S. patent application is a divisional application of U.S. patent application Ser. No. 12/465,344 filed on May 13, 2009, which is expressly incorporated herein by reference.

TECHNICAL FIELD

Certain embodiments of the present invention relate to automated secure access. More particularly, certain embodiments relate to systems, methods, and kits for automatically activating a garage door opener or other devices.

BACKGROUND

A garage door of a garage is typically opened or closed manually or by a user activating a garage door opener by pressing a button on a transmitter when the user desires to open or close the garage door. For example, when a user drives an automobile up to a garage door of the user's house, the user presses a button of a radio frequency (RF) transmitter positioned inside of the automobile (e.g., clipped to the driver side windshield visor). The RF transmitter transmits an encoded RF signal to a receiver of a garage door opener operatively connected to the garage door in response to pressing the button. Upon receiving the encoded RF signal, the receiver activates the garage door opener and the garage door opener proceeds to open the garage door.

Further limitations and disadvantages of conventional, traditional, and proposed approaches will become apparent to one of skill in the art, through comparison of such approaches with the subject matter of the present application as set forth in the remainder of the present application with reference to the drawings.

SUMMARY

An embodiment of the present invention comprises a method of automatically activating a garage door opener. The method includes sensing an automobile moving near a garage using a motion sensor and transmitting a first signal from the motion sensor to a transponder of the automobile in response to the sensing. The method further includes receiving the first signal at the automobile using the transponder and transmitting an access code signal from the transponder to a receiver of a garage door opener of the garage in response to receiving the first signal. The method also includes receiving the access code signal using the receiver and activating the garage door opener in response to receiving the access code signal. The first signal may include at least one of a radio frequency signal, an infrared signal, an acoustic signal, an ultrasonic signal, and a visible light signal. The access code signal may include at least one of a radio frequency signal, an infrared signal, an acoustic signal, an ultrasonic signal, and a visible light signal. The motion sensor may include at least one of an infrared motion detector, a radio frequency motion detector, an acoustic motion detector, an ultrasonic motion detector, and an optical motion detector. The garage door opener may include at least one of a mechanical garage door opener, an electro-mechanical garage door opener, a hydraulic garage door opener, and a pneumatic garage door opener. The method may further include disarming a security system of a house associated with the garage in response to opening a garage door of the garage as a result of activating the garage door opener. The method may also include arming the security system of the house associated with the garage in response to closing the garage door of the garage as a result of activating the garage door opener. The method may further include activating at least one device or at least one system of a house associated with the garage in response to opening a garage door of the garage as a result of activating the garage door opener. The method may also include de-activating at least one device or at least one system of a house associated with the garage in response to closing a garage door of the garage as a result of activating the garage door opener.

Another embodiment of the present invention comprises a system for automatically activating a garage door opener. The system includes means for sensing an automobile moving near a garage and means for transmitting a first signal toward the automobile in response to the sensing. The system further includes means for receiving the first signal at the automobile and means for transmitting an access code signal toward the garage in response to receiving the first signal at the automobile. The system also includes means for receiving the access code signal at the garage and means for opening and closing a garage door of the garage in response to receiving the access code signal. The first signal may include at least one of a radio frequency signal, an infrared signal, an acoustic signal, and ultrasonic signal, and a visible light signal. The means for sensing may include at least one of an infrared sensing means, a radio frequency sensing means, an acoustic sensing means, an ultrasonic sensing means, and an optical sensing means. The means for opening and closing may include at least one of a mechanical opening and closing means, an electro-mechanical opening and closing means, a hydraulic opening and closing means, and a pneumatic opening and closing means. The system may further include means for disarming a security system of a house associated with the garage in response to the garage door opening. The system may also include means for arming the security system of the house associated with the garage in response to the garage door closing.

A further embodiment of the present invention comprises a conversion kit for automating activation of a garage door opener. The conversion kit includes a transponder configured to be installed in an automobile and a motion sensor configured to be mounted outside of a garage. The motion sensor is configured to transmit a first signal to the transponder when the motion sensor senses the automobile moving near the garage. The transponder is configured to transmit a garage door opener access code signal. The transponder is further configured to receive the first signal and transmit the access code signal in response to receiving the first signal.

These and other novel features of the subject matter of the present application, as well as details of illustrated embodiments thereof, will be more fully understood from the following description and drawings.

DETAILED DESCRIPTION

Figure 1:
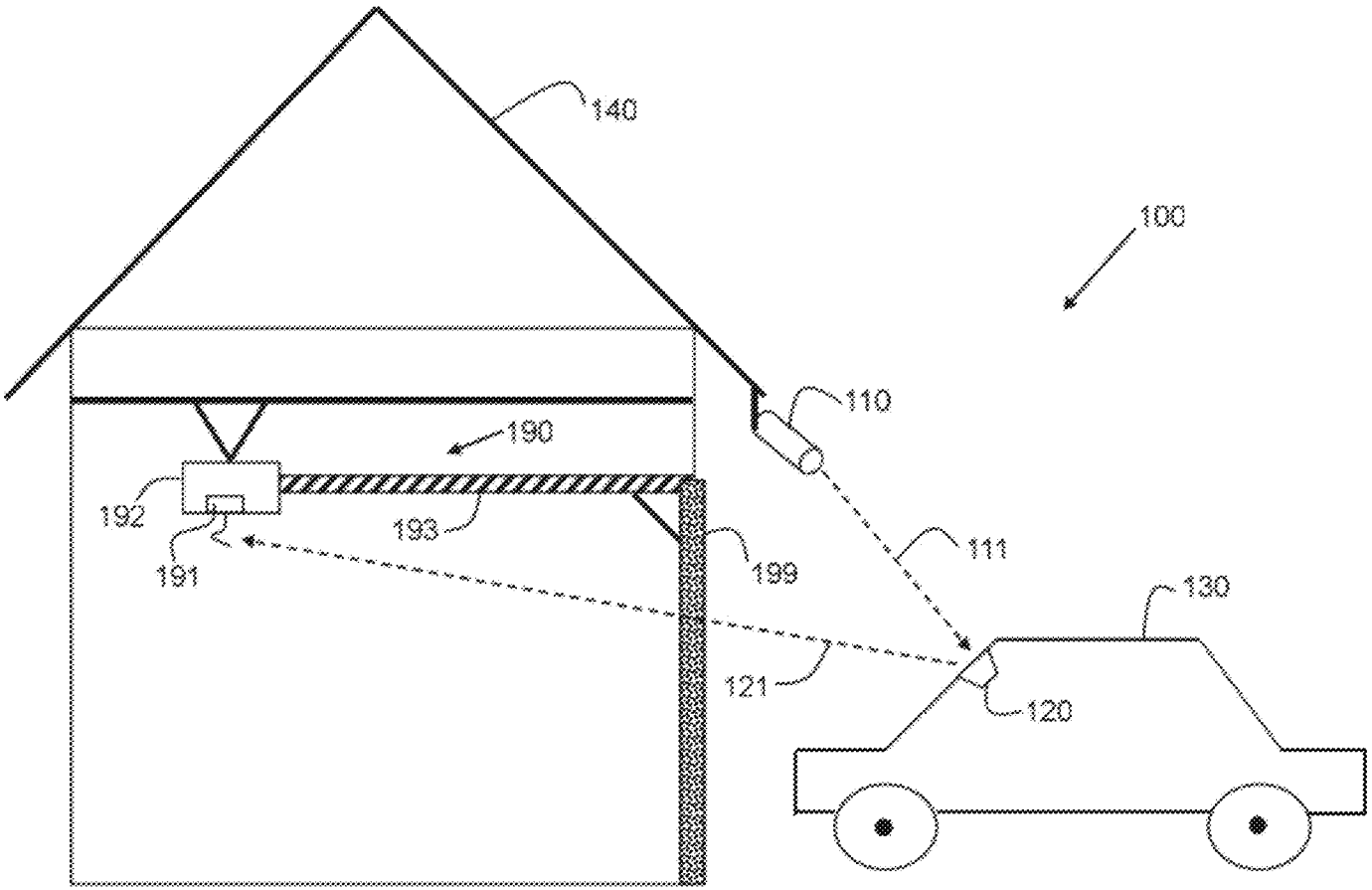
FIG. 1 illustrates a functional block diagram of a first embodiment of a system for automatically activating a garage door opener being shown as used in context.

FIG. 1 illustrates a functional block diagram of a first embodiment of a system 100 for automatically activating a garage door opener 190 being shown as used in context. The system 100 includes a motion sensor 110 mounted on a garage 140, a transponder 120 installed in an automobile 130, and a receiver 191 of the garage door opener 190. The garage door opener 190 is operatively connected to a garage door 199. The garage door opener 190 and the garage door 199 may be a traditional garage door opener and garage door, in accordance with an embodiment of the present invention.

For example, the garage door opener 190 may include an RF receiver 191 that activates a motor 192 of the garage door opener upon receiving a correct radio frequency access code. The motor 192 acts on a conveyor mechanism 193 which pulls the garage door up (and pushes the garage door down) along a pair of rails (not shown). Traditionally, a user pushes a button on a radio frequency transmitter, or pushes a button wired directly to the receiver 191 to activate the garage door opener 190. In accordance with various embodiments of the present invention, such user interaction is eliminated from the activation process. In accordance with various embodiments of the present invention, the garage door opener 190 may be at least one of a mechanical garage door opener, an electromechanical garage door opener, a hydraulic garage door opener, and a pneumatic garage door opener. Other garage door opener technologies may be possible as well.

Figure 2:
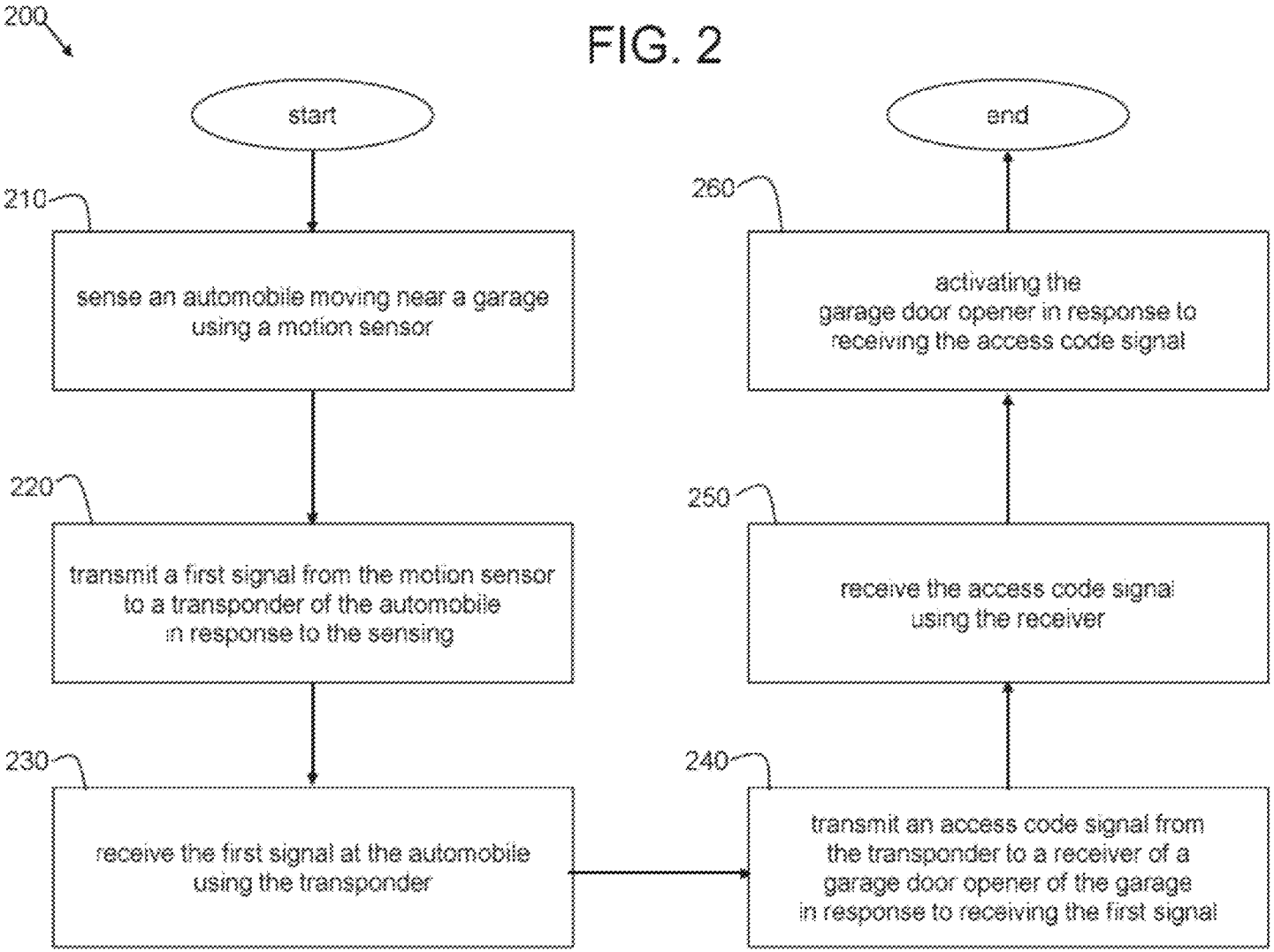
FIG. 2 illustrates a flow chart of a first embodiment of a method of automatically activating a garage door opener using the system of FIG. 1.

FIG. 2 illustrates a flow chart of a first embodiment of a method 200 of automatically activating a garage door opener using the system 100 of FIG. 1. In step 210, an automobile 130 that is moving near (e.g., pulling up to or pulling away from) a garage 140 is sensed using a motion sensor 110. The motion sensor 110 may include at least one of an infrared motion detector, a radio frequency motion detector, an acoustic motion detector, an ultrasonic motion detector, and an optical motion detector, which are well known in the art. Other types of motion detectors are possible as well. The motion sensor 110 is mounted externally to the garage 140 and positioned such that the motion sensor 110 may readily sense movement of the automobile 130 just outside of the garage 140.

In step 220, a first signal 111 is transmitted from the motion sensor 110 to the transponder 120 of the automobile 130 in response to the motion sensor 110 sensing the automobile 130. The transponder 120 is installed within the automobile 130, in accordance with an embodiment of the present invention. The first signal 111 may include at least one of a radio frequency signal, an infrared signal, an acoustic signal, an ultrasonic signal, and a visible light signal. Other types of signals are possible as well. In step 230, the first signal 111 is received at the automobile 130 by the transponder 120. In step 240, the transponder 120 transmits an access code signal 121 to the receiver 191 of the garage door opener 190 in response to receiving the first signal 111. The access code signal 121 may include at least one of a radio frequency signal, an infrared signal, an acoustic signal, an ultrasonic signal, and a visible light signal. Other types of signals are possible as well. Typically, for operation with traditional garage door openers, the access code signal 121 will be an encoded radio frequency signal. For infrared or visible light signals to be effective, a portion of the garage door 199 may need to be transparent.

In step 250, the access code signal 121 is received by the receiver 191. In step 260, the garage door opener 190 (e.g., the motor 192) is activated in response to the receiver 191 receiving the access code signal 121. If the garage door 199 is down, activation of the garage door opener will pull the door up. If the garage door 199 is up, activation of the garage door opener will push the door down. In accordance with an embodiment of the present invention, for security reasons, the access code signal 121 is correctly encoded with a predefined access code in order for the garage door opener 190 to be activated. As a result, using the system 100 of FIG. 1 according to the method 200 of FIG. 2, a driver of the automobile may pull up in front of the garage door 199 and the garage door 199 will automatically open without the driver having to specifically do anything else (e.g., push a button on a transmitter). Similarly, a driver of the automobile may pull out of the garage 140 and the garage door 199 will automatically close without the driver having to specifically do anything else. However, as a backup option, the transponder 120 may include, for example, a button which can be pressed to activate transmission of the signal 121. This may be advantageous if, for example, the motion sensor 110 fails.

In accordance with an optional embodiment of the present invention, a security system of a house associated with the garage 140 is disarmed in response to opening the garage door 199 as a result of activating the garage door opener 190. Similarly, the security system of the house associated with the garage 140 is armed in response to closing the garage door 199 as a result of activating the garage door opener 190. For example, a sensor operatively connected to the garage door opener 190 or to the garage door 199 may sense when the garage door is down and send a "garage door down" signal or data message to the security system. In response, the security system arms itself. If a "garage door down" signal or data message is not received by the security system, the security system may disarm itself. In this manner, when a user drives up to the garage 140 in an automobile 130 and the garage door 199 is automatically opened, the security system of the house is automatically disarmed and the user may enter the house without having to take separate specific user action to disarm the security system. Similarly, when a user pulls away from the garage 140 in an automobile 130 and the garage door 199 is automatically closed, the security system of the house is automatically armed and the user does not have to take separate specific action to arm the security system.

Figure 3:
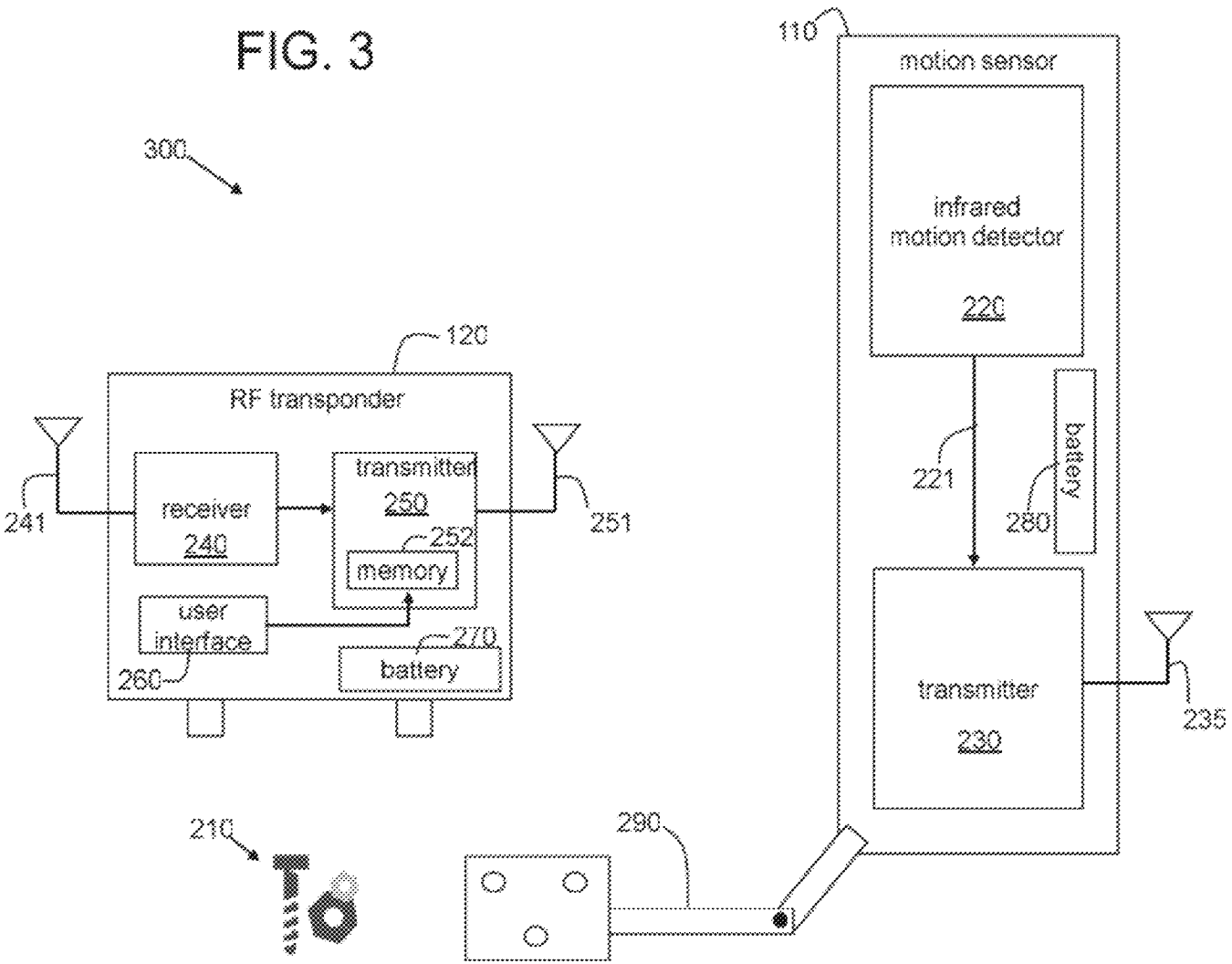
FIG. 3 illustrates a functional block diagram of a first embodiment of a conversion kit for automating activation of a garage door opener which may be used in the system of FIG. 1.

FIG. 3 illustrates a functional block diagram of a first embodiment of a conversion kit 300 for automating activation of a garage door opener 190 which may be used in the system 100 of FIG. 1. The kit 300 includes the motion sensor 110 and the transponder 120 from FIG. 1. The motion sensor 110 is capable of transmitting a first signal 111 to the transponder 120 when the motion sensor 110 senses the automobile 130 moving near the garage 140. The transponder 120 is capable of being programmed to transmit a garage door opener access code signal 121 and is further capable of receiving the first signal 111 and transmitting the programmed access code signal 121 in response to receiving the first signal 111.

The transponder 120 is capable of being installed inside an automobile 130, for example, via mounting hardware 210. Alternatively, the transponder 120 may be installed via an adhesive, a clip, or some other attachment means, or the transponder may simply rest, for example, on the dashboard of the automobile 130. For example, the transponder 120 may have a clip allowing the transponder 120 to be clipped to a windshield visor of the automobile 130. The motion sensor 110 is capable of being mounted outside of the garage 140, for example, via a mounting bracket 290 and mounting hardware 210. For example, the motion sensor 110 may be mounted beneath an overhang of a roof of the garage 140.

In accordance with an embodiment of the present invention, the motion sensor 110 includes an infrared motion detector 220 operatively connected to a transmitter 230. When the infrared motion detector 220 detects the movement of the automobile 130, a motion detect signal is sent along the signal path 221 to the transmitter 230. The transmitter 230 transmits the first signal 111 via an antenna 235 in response to receiving the motion detect signal over the signal path 221. The transmitter 230 may be a radio frequency transmitter, an infrared transmitter, or any other type of transmitter that is compatible with the transponder 120. As an alternative, the infrared motion detector 220 may instead be a radio frequency motion detector, an acoustic motion detector, an ultrasonic motion detector, an optical motion detector, or some other type of motion detector capable of sensing motion of the automobile 130. The motion sensor 110 includes a battery 280 or some other power source for powering the various components of the motion sensor 110. The motion sensor 110 includes a mounting bracket 290 allowing the motion sensor 110 to be mounted to the garage 140 using, for example, mounting hardware 210 (e.g., screws or nuts and bolts).

In accordance with an embodiment of the present invention, the transponder 120 is a radio frequency (RF) transponder and includes a receiver 240 operatively connected to a transmitter 250. The receiver 240 includes an RF antenna 241 and the transmitter 250 includes an RF antenna 251. The receiver 240 is capable of receiving the first signal 111 from the motion sensor 110 and the transmitter 250 is capable of transmitting the access code signal 121 to the garage door opener receiver 191. The transmitter 250 includes a memory 252 for storing an access code. The transponder 120 further includes a user interface 260 that allows a user to program an access code to be stored into the memory 252. The transmitter 250 is capable of reading the access code from the memory 252 and modulating the access code signal 121 with the access code. The access code is that code to which the garage door opener 190 responds. The user interface 260 may include a touch pad or selector switches, for example. The transponder 120 also includes a battery 270 or some other power source for powering the various components of the transponder 120.

Figure 4:
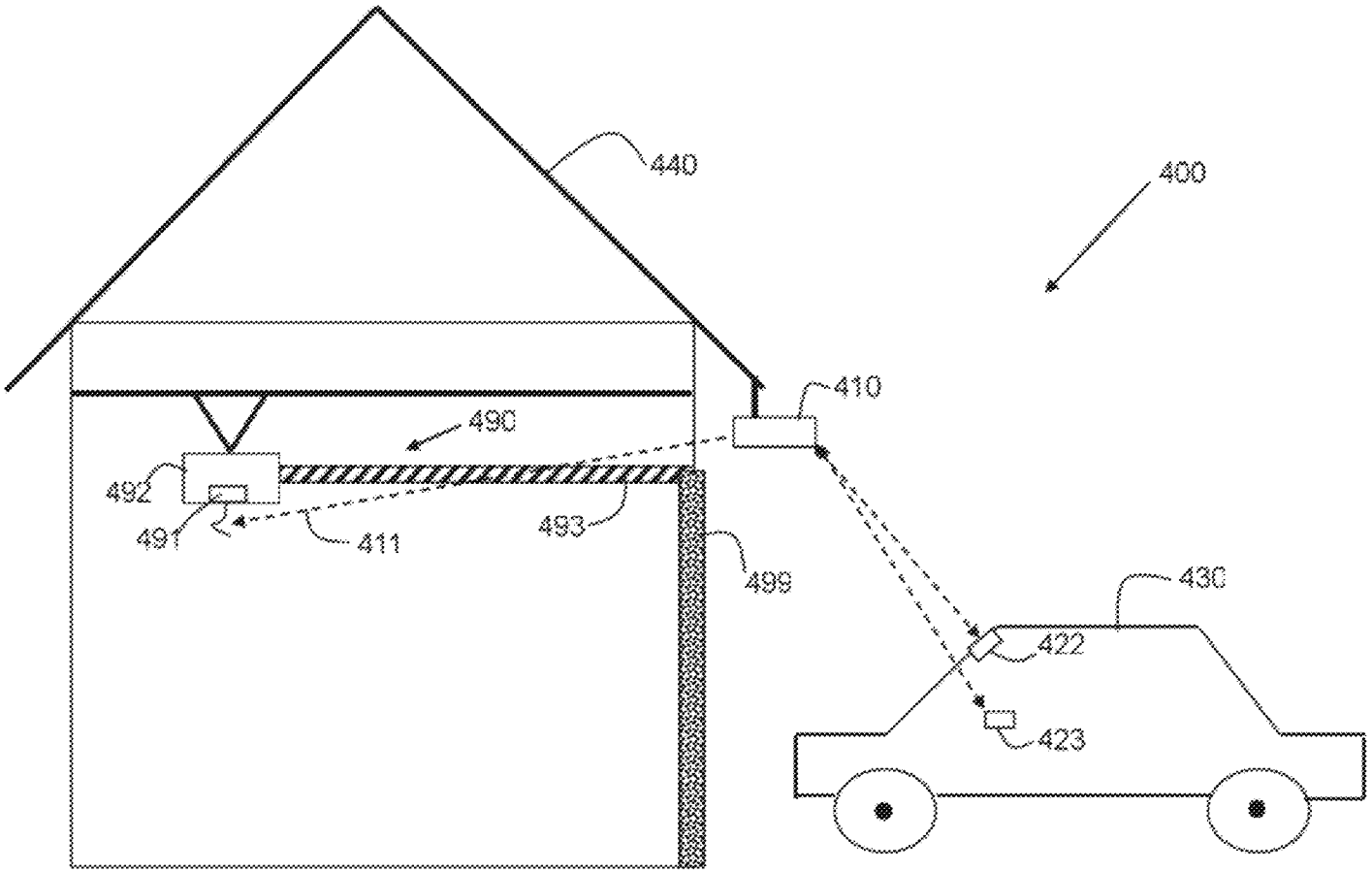
FIG. 4 illustrates a functional block diagram of a second embodiment of a system for automatically activating a garage door opener being shown as used in context.

FIG. 4 illustrates a functional block diagram of a second embodiment of a system 400 for automatically activating a garage door opener 490 being shown as used in context. The system 400 includes a radio frequency identification (RFID) reader 410 installed on a garage 440, a first RFID tag 422 and a second RFID tag 423, and a receiver 491 of the garage door opener 490. RFID technology, including RFID readers and tags, is well known. The garage door opener 490 is operatively connected to a garage door 499. The garage door opener 490 and the garage door 499 may be a traditional garage door opener and garage door, in accordance with an embodiment of the present invention.

For example, the garage door opener 490 may include an RF receiver 491 that activates a motor 492 of the garage door opener upon receiving a correct radio frequency access code. The motor 492 acts on a conveyor mechanism 493 which pulls the garage door up (and pushes the garage door down) along a pair of rails (not shown). Traditionally, a user pushes a button on a radio frequency transmitter, or pushes a button wired directly to the receiver 491 to activate the garage door opener 490. In accordance with various embodiments of the present invention, such user interaction is eliminated from the activation process. In accordance with various embodiments of the present invention, the garage door opener 490 may be at least one of a mechanical garage door opener, an electromechanical garage door opener, a hydraulic garage door opener, and a pneumatic garage door opener. Other garage door opener technologies may be possible as well.

Figure 5:
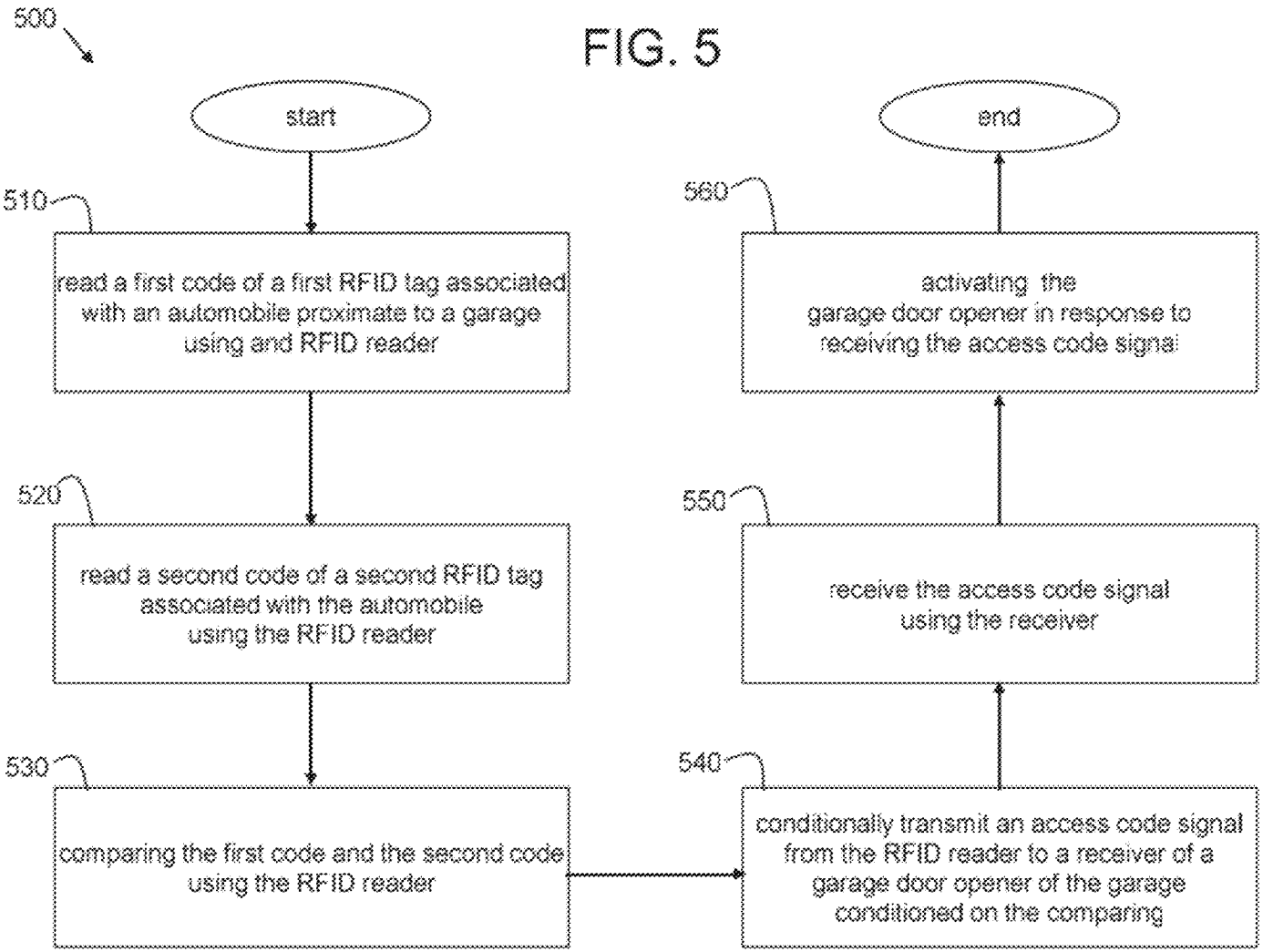
FIG. 5 illustrates a flow chart of a second embodiment of a method of automatically activating a garage door opener using the system of FIG. 4.

FIG. 5 illustrates a flow chart of a second embodiment of a method 500 of automatically activating a garage door opener using the system 400 of FIG. 4. In step 510, a first code of a first RFID tag 422 associated with an automobile 430 proximate to a garage 440 is read using an RFID reader 410. In step 520, a second code of a second RFID tag 423 associated with the automobile 430 is read using the RFID reader 410. In accordance with an embodiment of the present invention, the first RFID tag 422 is attached to or positioned within the automobile 430 and the second RFID tag 423 is attached to or embedded within an ignition key or a keychain associated with the automobile 430. Providing two RFID tags in the system 400 adds an extra measure of security to the system.

In step 530, the RFID reader 410 compares the read first code and the read second code. For example, the first code and the second code may be compared to each other to confirm that the codes are identical. Alternatively, the first code may be compared to a first stored code and the second code may be compared to a second stored code to verify that the codes are valid. Other comparison techniques are possible as well. Therefore, the comparing step 530 of the method 500 is meant to comprise all possible comparing steps that may be performed to verify and/or validate the two codes.

In step 540, an access code signal 411 is conditionally transmitted from the RFID reader 410 to a receiver 491 of a garage door opener 490 of the garage 440 conditioned on the comparing step 530. For example, the access code signal 411 may be transmitted only if the first read code and the second read code are identical. Alternatively, the access code signal 411 may be transmitted only if the first read code is identical to a first stored code in the RFID reader 410 and the second read code is identical to a second stored code in the RFID reader 410. Other conditions may be possible as well, in accordance with various embodiments of the present invention.

In step 550, the access code signal 411 is received by the receiver 491. In step 560, the garage door opener 490 is activated in response to the receiver 491 receiving the access code signal 411. The access code signal 411 may include at least one of a radio frequency signal, an infrared signal, an acoustic signal, an ultrasonic signal, and a visible light signal. Other types of signals are possible as well. Typically, for operation with traditional garage door openers, the access code signal 411 is an encoded radio frequency signal. For infrared or visible light signals to be effective, a portion of the garage door 499 may need to be transparent (e.g., a glass window may be provided in the garage door).

In step 550, the access code signal 411 is received by the receiver 491. In step 560, the garage door opener 490 (e.g., using the motor 492) is activated in response to the receiver 491 receiving the access code signal 411. If the garage door 499 is down, activation of the garage door opener 490 will pull the door up. If the garage door 499 is up, activation of the garage door opener 490 will push the door down. In accordance with an embodiment of the present invention, for security reasons, the access code signal 411 is correctly encoded with a predefined access code in order for the garage door opener 490 to be activated. As a result, using the system 400 of FIG. 4 according to the method 500 of FIG. 5, a driver of the automobile 430 may pull up in front of the garage door 499 and the garage door 499 will automatically open without the driver having to specifically do anything else (e.g., push a button on a transmitter). Similarly, a driver of the automobile 430 may pull out of the garage 440 and the garage door 499 will automatically close without the driver having to specifically do anything else.

In accordance with an optional embodiment of the present invention, a security system of a house associated with the garage 440 is disarmed in response to opening the garage door 499 as a result of activating the garage door opener 490. Similarly, the security system of the house associated with the garage 440 is armed in response to closing the garage door 499 as a result of activating the garage door opener 490. For example, a sensor operatively connected to the garage door opener 490 or to the garage door 499 may sense when the garage door is down and send a "garage door down" signal or data message to the security system. In response, the security system arms itself. If a "garage door down" signal or data message is not received by the security system, the security system may disarm itself. In this manner, when a user drives up to the garage 440 in an automobile 430 and the garage door 499 is automatically opened, the security system of the house is automatically disarmed and the user may enter the house without having to take separate specific user action to disarm the security system. Similarly, when a user pulls away from the garage 440 in an automobile 430 and the garage door 499 is automatically closed, the security system of the house is automatically armed and the user does not have to take separate specific action to arm the security system.

Figure 6:
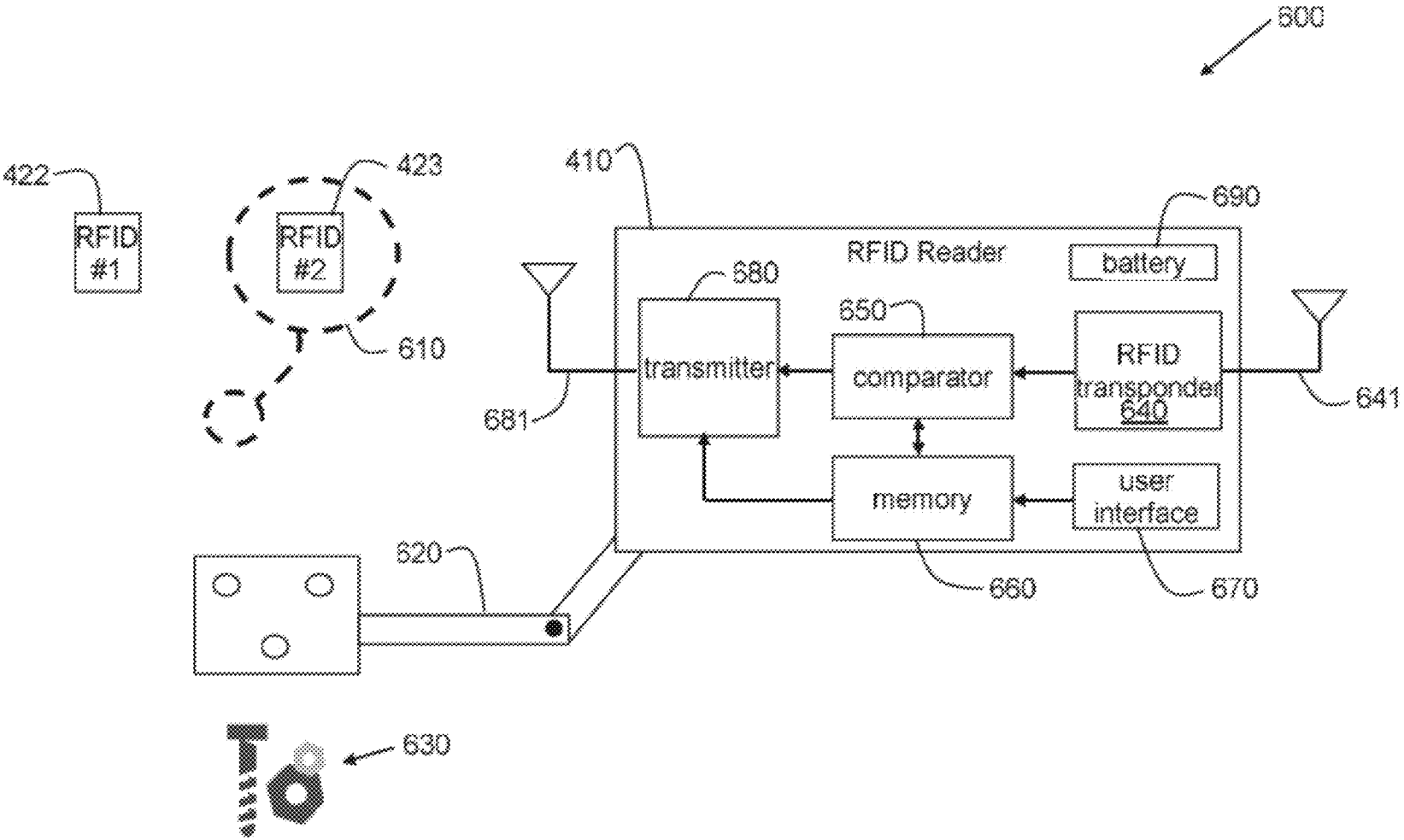
FIG. 6 illustrates a functional block diagram of a second embodiment of a conversion kit for automating activation of a garage door opener which may be used in the system of FIG. 4.

FIG. 6 illustrates a functional block diagram of a second embodiment of a conversion kit 600 for automating activation of a garage door opener which may be used in the system 400 of FIG. 4. The kit 600 includes the first RFID tag 422, the second RFID tag 423, and the RFID reader 410 from FIG. 4. The first RFID tag 422 is capable of being located within or attached to an automobile 430. The second RFID tag 423 is capable of being attached to an ignition key or keychain 610 associated with the automobile. The RFID tags may be attached in any of a multitude of ways including via an adhesive or via a clip. The keychain 610 is optionally an element of the kit 600. In accordance with one embodiment of the present invention, the keychain 610 is provided as part of the kit and the RFID tag 423 is embedded within the keychain 610.

The RFID reader 410 is capable of being mounted outside of a garage 440. For example, the RFID reader 410 may include a mounting bracket 620 allowing the RFID reader 410 to be mounted to the garage 440 using, for example, mounting hardware 630 (e.g., screws or nuts and bolts). For example, referring to FIG. 4, the RFID reader 410 may be mounted beneath an overhang of a roof of the garage 440.

The RFID reader 410 is capable of reading a first RFID code of the first RFID tag 422 and a second RFID code of the second RFID tag and comparing the RFID codes. The RFID reader 410 is further capable of being programmed to conditionally transmit a garage door opener access code signal 411 conditioned on the comparing. Transmitting of the access code may be done wirelessly or via wired means. The RFID reader 410 includes an RFID transponder 640 having an RF antenna 641 and is used to read the RFID tags. In accordance with an embodiment of the present invention, the RFID codes are encrypted and the RFID transponder 640 is capable of decrypting the RFID codes. The RFID reader 410 also includes a comparator 650 operatively connected to the RFID transponder 640 for comparing the read RFID codes from the tags. As previously described herein, the two read RFID codes may be compared to each other, or each read RFID code may be compared to a stored RFID code, for example, to validate the RFID codes.

The RFID reader 410 includes a memory 660 for storing RFID codes and for storing a programmed garage door opener access code. The RFID reader includes a user interface 670 to allow a user to program the access code and/or the RFID codes into the memory 660. The RFID reader 410 also includes a transmitter 680 having an antenna 681. The transmitter 680 is capable of reading the access code from the memory 660 and modulating the access code signal 411 with the access code. The access code is that code to which the garage door opener 490 responds. If the two RFID codes are validated by comparison, then the comparator, which is operatively connected to the transmitter 680, commands the transmitter 680 to transmit a garage door opener access code to activate the garage door opener 490. The comparator 650 may be, for example, a software programmable processor or some other electronic circuit. In accordance with an embodiment of the present invention, the transmitter 680 is a radio frequency transmitter. In accordance with other embodiments of the present invention, the transmitter 680 may be an infrared transmitter, an acoustic transmitter, an ultrasonic transmitter, an optical transmitter, or any other type of transmitter that is compatible with the receiver 491 of the garage door opener 490. The user interface 670 may include a touch pad or selector switches, for example. The RFID reader 410 also includes a battery 690 or some other power source for powering the various components of the RFID reader 410.

Figure 7:
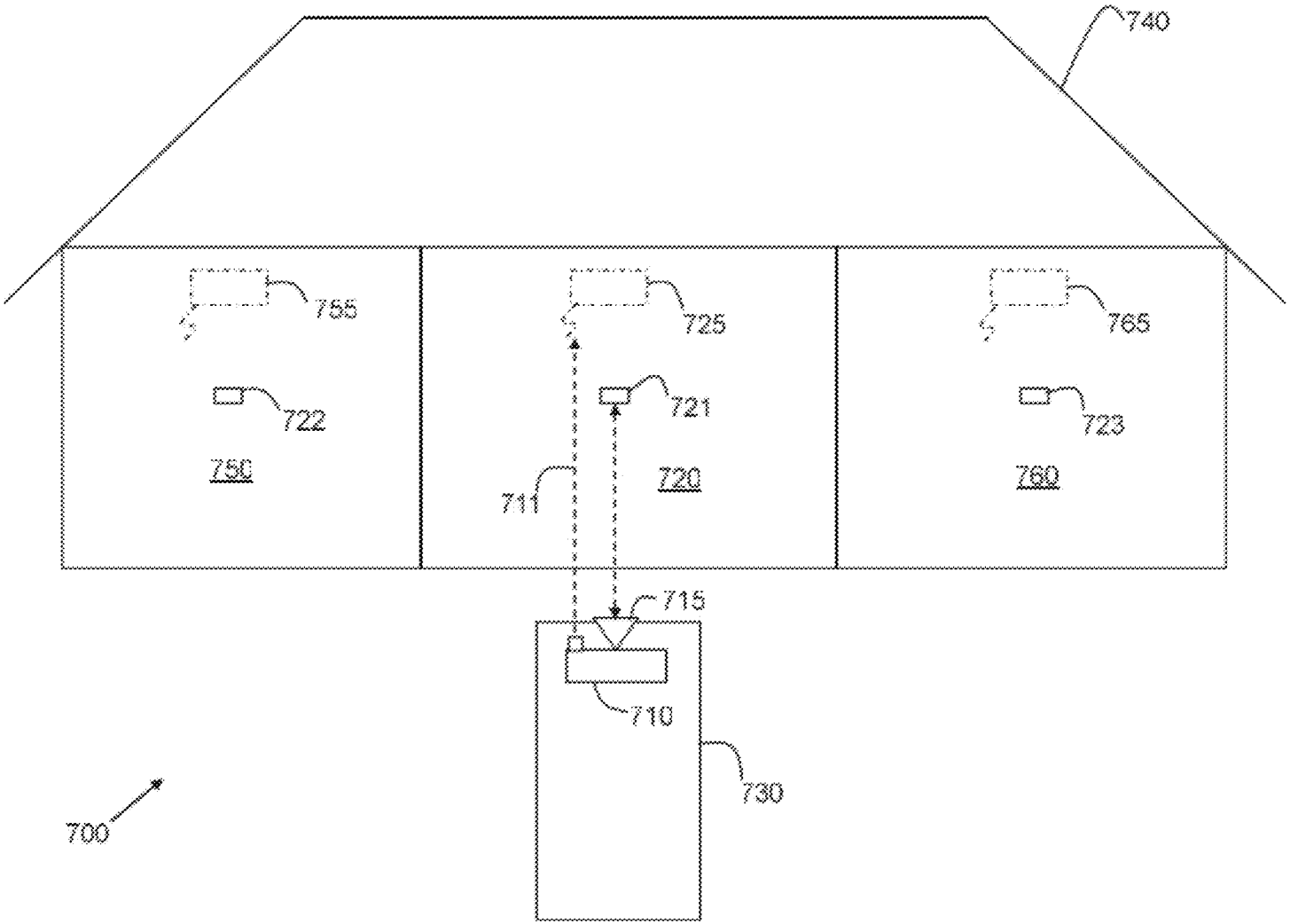
FIG. 7 illustrates a functional block diagram of a third embodiment of a system for automatically activating a garage door opener being shown as used in context.

FIG. 7 illustrates a functional block diagram of a third embodiment of a system 700 for automatically activating a garage door opener being shown as used in context. The system includes an RFID reader 710 installed in an automobile 730, a first RFID tag 721 attached to or embedded in a first garage door 720 of a garage 740, a second RFID tag 722 attached to or embedded in a second garage door 750 of the garage 740, and a third RFID tag 723 attached to or embedded in a third garage door 760 of the garage 740. The system 700 also includes a first garage door receiver 725 of a first garage door opener (not shown) operatively connected to the first garage door 720, a second garage door receiver 755 of a second garage door opener (not shown) operatively connected to the second garage door 750, and a third garage door receiver 765 of a third garage door opener (not shown) operatively connected to the third garage door 760. The garage door openers (not shown except for the receivers) may be traditional garage door openers as described previously herein, in accordance with an embodiment of the present invention.

Figure 8:
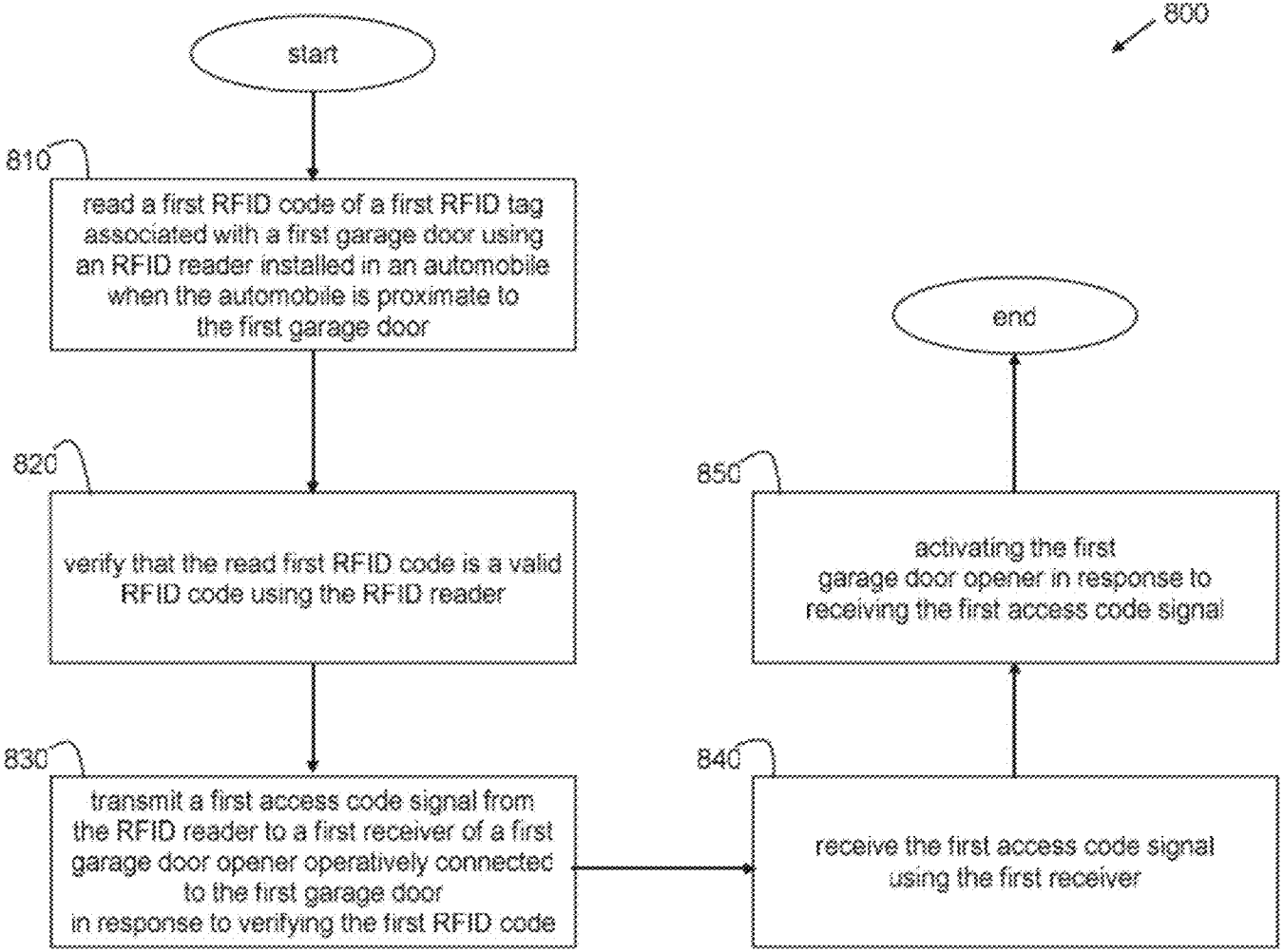
FIG. 8 illustrates a flow chart of a third embodiment of a method of automatically activating a garage door opener using the system of FIG. 7.

FIG. 8 illustrates a flow chart of a third embodiment of a method 800 of automatically activating a garage door opener using the system 700 of FIG. 7. In step 810, a first RFID code of a first RFID tag 721 associated with a first garage door 720 is read using an RFID reader 710 installed in an automobile 730 when the automobile 730 is proximate to the first garage door 720. In step 820, the RFID reader 710 verifies that the read first RFID code is a valid RFID code. For example, the RFID reader 710 may compare the read RFID code to a stored RFID code to ensure that the two codes are the same. In step 830, a first access code signal 711 is transmitted from the RFID reader 710 to a first receiver 725 of a first garage door opener operatively connected to the first garage door 720 in response to verifying the first RFID code.

In step 840, the first access code signal 711 is received using the first receiver 725 of the first garage door opener. In step 850, the first garage door opener is activated in response to the receiver 725 receiving the first access code signal 711. The access code signal 711 may include at least one of a radio frequency signal, an infrared signal, an acoustic signal, an ultrasonic signal, and a visible light signal. Other types of signals are possible as well. Typically, for operation with traditional garage door openers, the access code signal 711 is an encoded radio frequency signal. For infrared or visible light signals to be effective, a portion of the garage door may need to be transparent.

If the garage door 720 is down, activation of the garage door opener will pull the door up. If the garage door 720 is up, activation of the garage door opener will push the door down. In accordance with an embodiment of the present invention, for security reasons, the access code signal 711 is correctly encoded with a predefined access code in order for the garage door opener to be activated. However, the RFID reader 710 will only read the RFID tag on the garage door for which the automobile 730 is directly in front of and transmit only the access code for that garage door opener. Such garage door differentiation may be accomplished by, for example, a combination of low RF reader interrogation power and a highly directional RF antenna 715 of the RFID reader 710.

As a result, using the system 700 of FIG. 7 according to the method 800 of FIG. 8, a driver of the automobile 730 may pull up in front of any one of the garage doors 720, 750, or 760 and the correct garage door will automatically open without the driver having to specifically do anything else (e.g., push a button on a transmitter). Similarly, a driver of the automobile 730 may pull out of the garage 740 via any one of the garage doors 720, 750, or 760 and the correct garage door will automatically close without the driver having to specifically do anything else. However, as a backup option, the RFID reader 710 may include, for example, at least two buttons, one of which may be pressed to activate transmission of the appropriate signal 711. This may be advantageous if, for example, the RFID tag fails.

In accordance with an optional embodiment of the present invention, a security system of a house associated with the garage 740 is disarmed in response to opening any one of the garage doors 720, 750, or 760 as a result of activating the corresponding garage door opener. Similarly, the security system of the house associated with the garage 740 is armed in response to closing any one of the garage doors as a result of activating the corresponding garage door opener. For example, a sensor operatively connected to one of the garage door openers or to one of the garage doors may sense when that garage door is down and send a "garage door down" signal or data message to the security system. In response, the security system arms itself. If a "garage door down" signal or data message is not received by the security system, the security system may disarm itself. In this manner, when a user drives up to the garage 740 in an automobile 730 and a garage door (e.g., 760) is automatically opened, the security system of the house is automatically disarmed and the user may enter the house without having to take separate specific user action to disarm the security system. Similarly, when a user drives away from the garage 740 in an automobile 730 and the garage door (e.g., 760) is automatically closed, the security system of the house is automatically armed and the user does not have to take separate specific action to arm the security system. In accordance with an embodiment of the present invention, all garage doors 720, 750, and 760 of the garage 740 may have to be down in order for the security system to be automatically armed.

Figure 9:
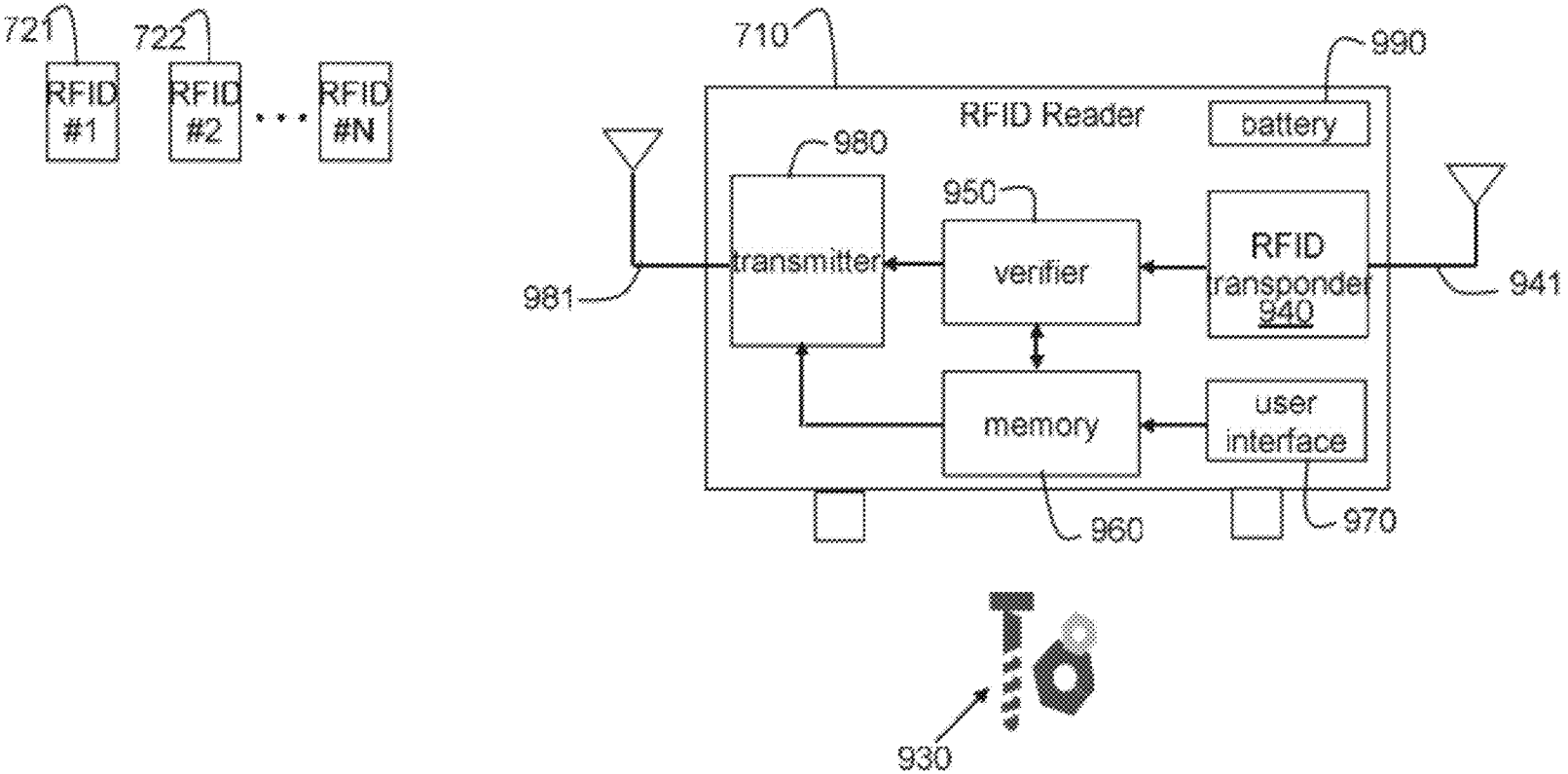
FIG. 9 illustrates a functional block diagram of a third embodiment of a conversion kit for automating activation of a garage door opener which may be used in the system of FIG. 7.

FIG. 9 illustrates a functional block diagram of a third embodiment of a conversion kit 900 for automating activation of a garage door opener which may be used in the system 700 of FIG. 7. The kit 900 includes at least two RFID tags 721 and 722 and the RFID reader 710 from FIG. 7. Two RFID tags would suffice for a two-car garage, three RFID tags would suffice for a three-car garage, etc. Each RFID tag is capable of being attached to or mounted on a separate garage door of a multi-door garage. The RFID tags may be attached or mounted in any of a multitude of different ways including via an adhesive, for example. The RFID reader 710 is capable of being installed in the automobile 730 via, for example, mounting hardware 930 (e.g., screws or nuts and bolts). For example, the RFID reader 710 may be installed between the windshield and a rear-view mirror of the automobile.

The RFID reader 710 is capable of being programmed to store at least two garage door opener access codes and at least two RFID codes. Furthermore, the RFID reader 710 is capable of reading an RFID code of one of the RFID tags when the automobile is directly in front of a garage door that the one RFID tag is attached to. The RFID reader 710 is capable of verifying that the read RFID code is a valid RFID code and is capable of conditionally transmitting one of at least two garage door opener access codes as an access code signal conditioned on the read and verified RFID code. Transmitting of the access code signal is done wirelessly.

The RFID reader 710 includes an RFID transponder 940 having an RF antenna 941 and is used to read the RFID tags. In accordance with an embodiment of the present invention, the RFID codes are encrypted and the RFID transponder 940 is capable of decrypting the RFID codes. The RFID reader 710 also includes a verifier 950 operatively connected to the RFID transponder 940 for verifying the validity of the read RFID codes from the tags. The verifier 950 may be, for example, a software programmable processor or some other electronic circuit. As previously described herein, a read RFID code may be compared to a stored RFID code, for example, to validate the RFID code.

The RFID reader 710 includes a memory 960 for storing RFID codes and for storing programmed garage door opener access codes. The RFID reader 710 includes a user interface 970 to allow a user to program the access codes and/or the RFID codes into the memory 960. The RFID reader 710 also includes a transmitter 980 having an antenna 981. The transmitter 980 is capable of reading an access code from the memory 960 and modulating the access code signal 711 with the access code. The correct access code is that access code to which the garage door opener responds. If an RFID code is verified as being valid, then the verifier 950, which is operatively connected to the transmitter 980, commands the transmitter 980 to transmit a corresponding garage door opener access code to activate the corresponding garage door opener. In accordance with an embodiment of the present invention, the transmitter 980 is a radio frequency transmitter. In accordance with other embodiments of the present invention, the transmitter 980 may be an infrared transmitter, an acoustic transmitter, an ultrasonic transmitter, an optical transmitter, or any other type of transmitter that is compatible with the receivers 725, 755, and 765 of the garage door openers of the garage 740. The user interface 970 may include a touch pad or selector switches, for example. The RFID reader 710 also includes a battery 990 or some other power source for powering the various components of the RFID reader 710.

In accordance with other optional embodiments of the present invention, other devices and systems such as lights within the home, a coffee maker within the home, the heating system of a swimming pool of the home, and/or a hot tub or jacuzzi of the home may be activated in response to opening the garage door of a home as a result of activating a garage door opener. Similarly, such systems or devices may be deactivated in response to closing the garage door of the home as a result of activating the garage door opener.

In general, the entire home may be "woken up" in response to opening a garage door of the home as a result of activating the associated garage door opener, or "put to sleep" in response to closing the garage door of the home as a result of activating the associated garage door opener. For example, a family arriving at home from vacation may pull up the driveway of the home toward the garage door, automatically activating the garage door opener according to one of the systems and methods as described herein. As a result, a water heater and an air conditioner or furnace may all be automatically activated, at least one door to the home may be automatically unlocked (e.g., a front door or a door, other than the garage door, leading from the garage into the house), and a thermostat temperature setting may be automatically adjusted.

Other devices and systems may be activated or deactivated as well, in accordance with various embodiments of the present invention. For example, when arriving at home and activating the garage door opener to open the garage door, a device that turns on the utilities (e.g., water and natural gas) within the home may be activated. The activating links from the garage door opener to the other various home systems and devices may be wired, wireless, or a combination thereof, using technologies that are well known in the art.

In summary, systems, methods, and kits for automatically activating a garage door opener are disclosed. A garage door opener system is supplemented with motion sensor technology or RFID technology to allow for automatic activation of a garage door opener. An automobile that is moving near or is proximate to a garage associated with at least one garage door opener can cause the garage door opener to be automatically activated to open or close a garage door that is operatively connected to the garage door opener.

While the claimed subject matter of the present application has been described with reference to certain embodiments, it will be understood by those skilled in the art that various changes may be made and equivalents may be substituted without departing from the scope of the claimed subject matter. In addition, many modifications may be made to adapt a particular situation or material to the teachings of the claimed subject matter without departing from its scope. Therefore, it is intended that the claimed subject matter not be limited to the particular embodiment disclosed, but that the claimed subject matter will include all embodiments falling within the scope of the appended claims.

What is claimed is:

1. A method of automatically activating a garage door opener, said method comprising:

sensing an automobile moving near a garage using a motion sensor;

transmitting a first signal from said motion sensor to a transponder of said automobile in response to said sensing;

receiving said first signal at said automobile using said transponder;

transmitting an access code signal from said transponder to a receiver of a garage door opener of said garage in response to receiving said first signal;

receiving said access code signal using said receiver; and activating said garage door opener in response to receiving said access code signal.

2. The method of claim 1 wherein said first signal includes at least one of a radio frequency signal, an infrared signal, an acoustic signal, an ultrasonic signal, and a visible light signal.

3. The method of claim 1 wherein said access code signal includes at least one of a radio frequency signal, an infrared signal, an acoustic signal, an ultrasonic signal, and a visible light signal.

4. The method of claim 1 wherein said motion sensor includes at least one of an infrared motion detector, a radio frequency motion detector, an acoustic motion detector, an ultrasonic motion detector, and an optical motion detector.

5. The method of claim 1 wherein said garage door opener includes at least one of a mechanical garage door opener, an electro-mechanical garage door opener, a hydraulic garage door opener, and a pneumatic garage door opener.

6. The method of claim 1 further comprising disarming a security system of a house associated with said garage in response to opening a garage door of said garage as a result of activating said garage door opener.

7. The method of claim 1 further comprising arming a security system of a house associated with said garage in response to closing a garage door of said garage as a result of activating said garage door opener.

8. The method of claim 1 further comprising activating at least one device or at least one system of a house associated with said garage in response to opening a garage door of said garage as a result of activating said garage door opener.

9. The method of claim 1 further comprising de-activating at least one device or at least one system of a house associated with said garage in response to closing a garage door of said garage as a result of activating said garage door opener.

10. A system for automatically activating a garage door opener, said system comprising:

means for sensing an automobile moving near a garage;

means for transmitting a first signal toward said automobile in response to said sensing;

means for receiving said first signal at said automobile;

means for transmitting an access code signal toward said garage in response to receiving said first signal at said automobile;

means for receiving said access code signal at said garage; and means for opening and closing a garage door of said garage in response to receiving said access code signal.

11. The system of claim 10 wherein said first signal includes at least one of a radio frequency signal, an infrared signal, an acoustic signal, an ultrasonic signal, and a visible light signal.

12. The system of claim 10 wherein said access code signal includes at least one of a radio frequency signal, an infrared signal, an acoustic signal, an ultrasonic signal, and a visible light signal.

13. The system of claim 10 wherein said means for sensing includes at least one of an infrared sensing means, a radio frequency sensing means, an acoustic sensing means, an ultrasonic sensing means, and an optical sensing means.

14. The system of claim 10 wherein said means for opening and closing includes at least one of a mechanical opening and closing means, an electro-mechanical opening and closing means, a hydraulic opening and closing means, and a pneumatic opening and closing means.

15. The system of claim 10 further comprising means for disarming a security system of a house associated with said garage in response to said garage door opening.

16. The system of claim 10 further comprising means for arming a security system of a house associated with said garage in response to said garage door closing.

17. A conversion kit for automating activation of a garage door opener, said conversion kit comprising:

a transponder configured to be installed in an automobile; and a motion sensor configured to be mounted outside of a garage, wherein said motion sensor is configured to transmit a first signal to said transponder when said motion sensor senses said automobile moving near said garage, and wherein said transponder is configured to transmit a garage door opener access code signal, and wherein said transponder is configured to receive said first signal and transmit said access code signal in response to receiving said first signal.

* * * * *